United States Patent [19]

Kinberg et al.

[11] Patent Number: 4,734,074

[45] Date of Patent: Mar. 29, 1988

[54] ANIMATED NOVELTY DEVICE

[76] Inventors: Benjamin Kinberg, 200 Fifth Ave., New York, N.Y. 10010; Robert Hudson, 103 Valley St., Seekonk, Mass. 02771

[21] Appl. No.: 12,638

[22] Filed: Feb. 9, 1987

[51] Int. Cl.[4] ..... A63H 3/31; A63H 3/38

[52] U.S. Cl. ..... 446/184; 446/485; 200/85 R

[58] Field of Search ..... 446/184, 183, 485, 372, 446/213, 197, 193; 200/86 R, 85 R

[56] References Cited

U.S. PATENT DOCUMENTS 1,110,100 9/1914 Ambash et al. ..... 446/184

2,877,324 3/1959 Oshry ..... 200/85 R X 3,086,093 4/1963 Barker ..... 200/85 R 4,282,680 8/1981 Zaruba ..... 446/485 X

*Primary Examiner*—Mickey Yu

*Attorney, Agent, or Firm*—Arthur T. Fattibene

[57] ABSTRACT

An animated novelty device which is shaped in the form of an animated creature having a flexible body portion and a head portion having eyes. The eyes include a light source connected in a circuit which is operatively associated with a sound producing device which is located within the body portion of the animated device. The arrangement is such that when a force or pressure is applied to the body portion of the device, a sound or voice associated with the animated creature is sounded and simultaneously therewith the eyes light up.

2 Claims, 5 Drawing Figures

ANIMATED NOVELTY DEVICE

FIELD OF INVENTION

This invention is directed to a novelty device, e.g. a child's toy which is formed in the shape of an animated creature which is capable of emitting a sound as its eyes light up when actuated.

PRIOR ART

Various efforts have been made to provide an animated device in the form of dolls, squeeze toys, stuffed toys and the like which simulate various types of creatures, e.g. humans and animal shapes. Some such devices are provided with various sounding means to impart a cry or sound to the device. Also, such known dolls or toys have been made with movable limbs or appendages to simulate or animate a living being. The object behind all of such known construction is to provide a novel and interesting toy by which a small child may amuse itself. While such doll like toys are well known, continuing efforts are being made to devise new, interesting and novel devices in this field of endeavor.

OBJECTS

An object of this invention is to provide a new and interesting animated novelty device which is relatively simple in construction, positive in operative and sufficiently interesting to a small child.

Another object is to provide an animated novelty device provided with a relatively simple mechanism which can be readily operated by a small child that will result in emitting a sound associated with the animated device and the lighting up of its eyes.

Another object is to provide an animated squeeze type toy which will emit a sound and light up the eyes when squeezed.

Another object is to provide in an animated squeeze type toy, a relatively simple electric circuit which is operatively associated with a sounding means whereby the toy will blink its eyes and sound its voice when squeezed by a child.

SUMMARY OF THE INVENTION

The foregoing objects and other features and advantages are attained by an animated novelty device having a hollow body and a head portion shaped to simulate a well-known creature. The body is formed of a resilient or flexible material which, when pressed, will deflect and which is inherently elastic so as to resume its original shape when pressure is released. Disposed within the body portion is a collapsible bellows and associated voice box for emitting a sound associated with the animated device when pressed. Associated with the bellows is an electrical circuit which includes a pair of lights which simulate the eyes of the animated device. Connected in circuit with the lights is a power source, e.g. a battery and a switch of energizing the circuit when closed. The switch comprises a pair of contact plates and is operatively associated with the bellows, so that when the bellows is compressed, the contact plates engage to energize the eye lights and a sound simulating the voice of the animated device is emitted.

FEATURES

A feature of this invention resides in the provision of a combination voice producing means and an electrical circuit disposed in the body of an animated toy or device which, when actuated, will simultaneously make a sound and light up a portion of the device.

Another feature of this invention resides in the provision of a collapsible bellows having an electrical switch connected thereto which will energize an electrical circuit when the bellows is compressed.

Another feature is to provide an animated toy or device with illuminated eyes connected in a circuit having a switching arrangement for energizing the eyes of the toy by the application of either an axial or non-axial pressure.

Another feature resides in the provision of an animated novelty device in the shape of an owl having illuminated eyes and a voice box for simulating the "hoot" of an owl and the lighting up of its eyes when squeezed.

Other features and advantages will become more readily apparent when considered in view of the drawings and specifications in which.

DETAIL DESCRIPTION

Figure 1:
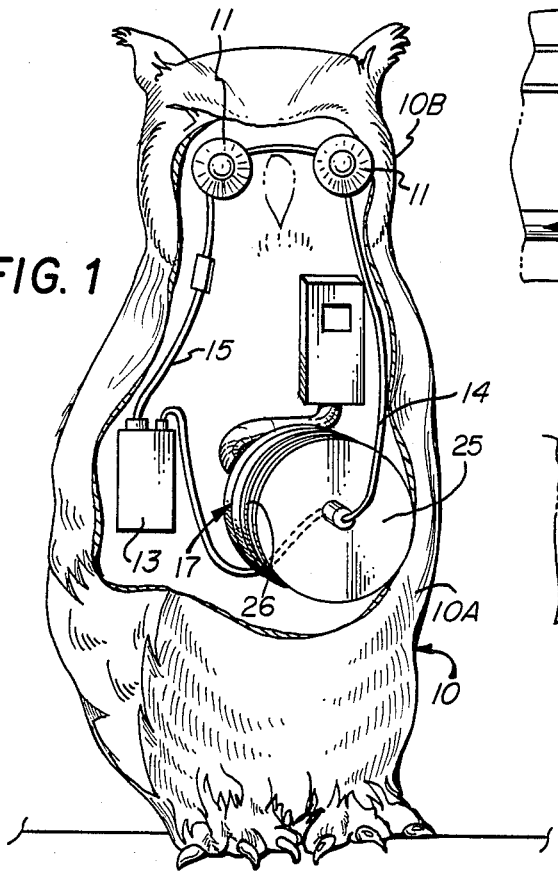
FIG. 1 is a perspective view of an embodiment of the invention, having portions thereof broken away.
Figure 2:
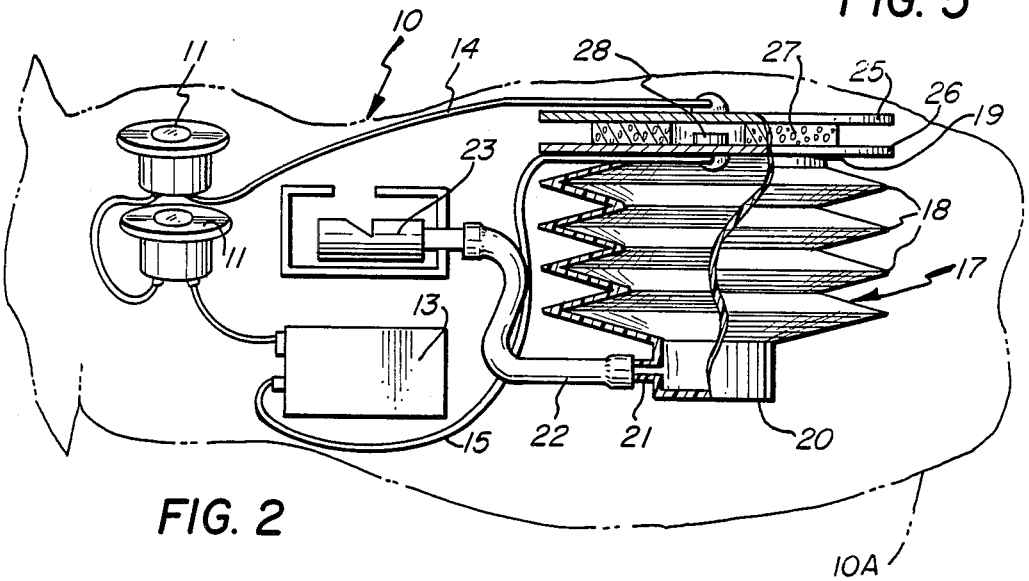
FIG. 2 is a partial perspective and section view to illustrate the internal operating mechanism of the device.

Referring to the drawings, thee is shown in FIGS. 1 and 2, an animated novelty device 10 embodying the invention. In the illustrated embodiment, the novelty device comprises a squeeze toy shaped in the form of an owl. However, it will be understood that they toy or device 10 may be formed in any desired shape so as to simulate any well-known creature, be it human or animal like. The device 10 includes a hollow body portion 10A which may be formed of any suitable flexible material which can be readily squeezed, and which will assume its original shape when the squeezing pressure is released. Associated with the body portion 10A is a head portion 10B. Defining the eyes of the animated device 10 are a pair of light sources 11, 11 which may comprise a light bulb or LED device which will illuminate or light up when its associated electrical circuit 12 is energized.

Figure 5:
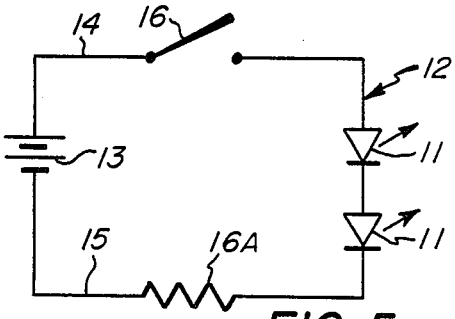
FIG. 5 is a schemmatic of the electrical circuit.

Referring to FIG. 5, the electrical circuit comprises the pair of light souirces or LED 11, 11 connected to a source of power, e.g. battery 13, by leads 14, 15. A swith 16 is interposed in lead 14 to energize and de-energize the light sources 11, 11, or the eyes of the animated device 10. In a preferred embodiment, the light sources or LED's 11, 11 are of the blinking variety, i.e., the eyes or light source 11, 11 will blink when energized. Completing the circuit 12 is a resistor 16 disposed in lead 15 in series with the battery 13.

Disposed within the body 10A of the animated device 10 is a collapsible bellows 17 which is preferably integrally molded of a plastic material. As shown, the bellows 17 is provided with a plurality of pleats or folds 18 disposed between the ends 19 and 20 of the bellows.

Normally, the bellows 17 will assume its expanded position as shown in FIG. 2.

Connected to the outlet 21 of the bellows 17 is a conduit or hose 22 connected in communication with a voice box 23 which is shaped to emit a sound which simulates the voice of the simulated creature. In the illustrated embodiment, the sound produced by the voice box 23 is intended to simulate the "hoot" of an owl.

In accorddance with this invention, an end wall, e.g. wall 19 of the bellows, is disposed adjacent to the flexible portion of the body, so that when a child squeezes the toy, the bellows 17 is compressed to force air through the sound or voice box 23 to generate the "hoot" or voice of the animated device.

Figure 3:
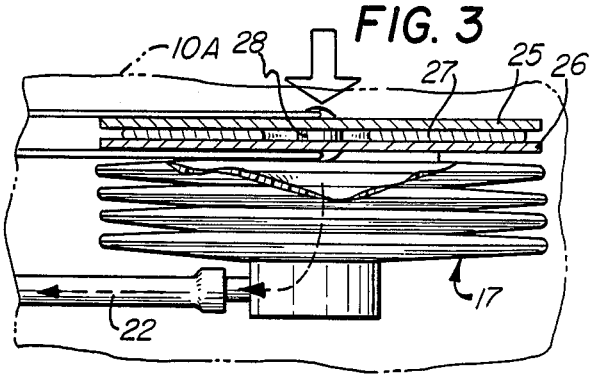
FIG. 3 is an enlarged sectional view of a detail of construction illustrating the actuation of the bellows and associated switch by the application of an axial force thereon.
Figure 4:
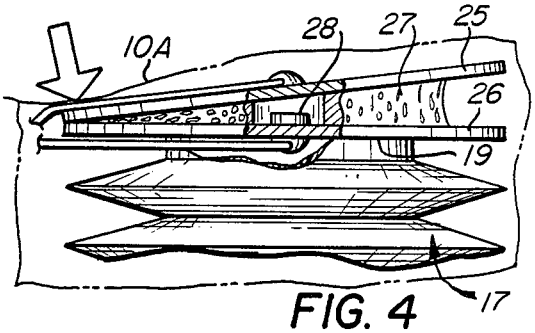
FIG. 4 is a view similar to that of FIG. 3, but illustrating the actuation of the mechanism by the application of a non-axial force thereon.

To energize the circuit 12 simultaneously with the generation of the voice or sound, a novel switching arrangement is provided for energizing the illuminated eyes or lights 11, 11. As best seen in FIGS. 2, 3 and 4, the switch means 16 comprises a pair of spaced apart contact plates 25, 26. In the illustrated embodiment, the contact plates are shown as a pair of superimposed discs. Disc 26 is suitably connected to the end 19 of the collapsible bellows disposed adjacent the flexible body portion of the animated device 10. A resilient spacer 27, e.g., a foam rubber pad, is disposed between the contact disc 25, 26 to maintain the disc in an "open" switch arrangement. In the illustrated embodiment, the contact plate or disc 26 is provided with a contact button 28 electrically connected to its associated disc 26 and to lead 15 of circuit 12. As best seen in FIG. 3, the resilient pad or spacer 27 compirses an annular member which circumscribes the contact button 28. In the normal or "open circuit" position, the contact plate 25 is normally spaced from the lower contact plate 26 and its associated contact button 28. Contact plate 25, in turn, is electrically connected to lead 14 of circuit 12.

With the construction described, it will be noted that when a child applies an axial force or pressure on the flexible body of the toy opposite the bellows 17, as best seen in FIG. 3, the contact plates 25 and 26 are forced together so that contact disc 25 engages the contact button 28 to close the electric circuit 12, thus causing the eye lights 11, 11 to illuminate or blink. At the same time, the bellows 17 is compressed forcing air through the voice box 23 to generate the "hoot" or voice of the animated device 10.

Should the child apply a non-axial force on the end of the bellows as sen in FIG. 4, the contact plates 25, 26 are angularly displaced as shown; whereby the peripheral portion of the respective contact plates engage to energize the circuit 12. To insure contact of the peripheral portions of the contact plates 25, 26, the diameter of the spacer 27 is made smaller that that of the contact disc 25, 26. Thus, with the construction described, the circuit for illuminating the "eyes" of the animated device can be effected by simply applying a force or squeezing pressure anywhere in the general vicinity of the bellows or contact discs; so that both the bellows and the contact disk can be simultaneously actuated to co-ordinate the sounding of the voice box 23 and the illumination of the eyes. This joint activity greatly adds to the play value of the device and enhances a child's enjoyment.

While the invention has been illustrated and described as to a particular embodiment, it will be readily appreciated that variations or modifications thereof may be made without departing from the spirit or scope of the invention.

What is claimed is:

1. An animated novelty device comprising a body simulating an animated creature having a head portion with eyes, voice means for creating a voice associated with said animated creature, said means for creating said voice being disposed within the body of said animated creature, an electric circuit connected to said voice means, said electric circuit including a light means simulating the eyes of said animated creature, a power source connected in said circuit for energizing said light means, and a switch means disposed in said circuit for opening and closing said circuit, said switch means being connected to said voice means whereby said switch means and voice means are actuated simultaneously to energize said light means and to sound said voice means, said switch means including a pair of spaced apart contact disc plates, a contact button axially connected to one of said contact disc plates, a resilient spacer disposed about said contact button and disposed between said disc plates, said disc plates having a peripheral portion extending beyond the peripheral portion of said spacer, and said body having a resilient portion opposite said switch means which can be readily deformed to actuate said switch means and associated voice means whereby said switch means is actuated by the application of either an axial or non-axial force applied thereto, and said resilient portion of said body assuming its normal position when the applied force is removed.

2. An animated novelty device comprising a hollow body simulating an animated creature having a head portion with eyes, said body having a resilient portion which can be readily compressed when a force is applied thereto, and which resilient portion will assume its normal position when the applied force is released, a compressible bellows having one end thereof disposed within said body adjacent said resilient portion, a voice box connected in communiction with said bellows to be actuated thereby when said resilient portion is compressed, an electric circuit disposed within said body, said electric circuit including a pair of light bulbs simulating the eyes of said animated creature, a power source connected in circuit with said light bulbs, and a switch means connected in said circuit for energizing and de-energizing said circuit upon the actuation of said bellows, said switch means including a pair of contact plates, one of said contact plates being connected to one end of said bellows, a resilient spacer disposed between said contact plates for maintaining said plates in normally spaced apart relationship, each of said contact plates being electrically connected in said circuit, and said contact plates having an outer peripheral portion thereof extending beyond the periphery of said spacer, whereby the application of a force on said bellows causes cant contact plates to close said circuit to energize said light bulbs and actuate said voice box, one of said contact plates including a contact button axially disposed thereon, and said spacer comprises an annularly shaped member circumscribing said contact button whereby said circuit is energized by the application of either an axal or non-axial force applied to said bellows.

* * * * *